US009301899B2

(12) United States Patent
Amer

(10) Patent No.: US 9,301,899 B2
(45) Date of Patent: Apr. 5, 2016

(54) OVERHEAD STANDING AND AMBULATION ASSISTIVE EXERCISE DEVICE

(71) Applicant: Louis J. Amer, Chesterland, OH (US)

(72) Inventor: Louis J. Amer, Chesterland, OH (US)

( * ) Notice: Subject to any disclaimer, the term of this patent is extended or adjusted under 35 U.S.C. 154(b) by 0 days.

(21) Appl. No.: 14/732,033

(22) Filed: Jun. 5, 2015

(65) Prior Publication Data

US 2016/0015591 A1 Jan. 21, 2016

Related U.S. Application Data

(60) Provisional application No. 62/007,999, filed on Jun. 5, 2014.

(51) Int. Cl.

| | |
|---|---|
| ***A63B 22/00*** | (2006.01) |
| ***A61H 3/00*** | (2006.01) |
| ***A63B 21/00*** | (2006.01) |
| ***A63B 23/04*** | (2006.01) |

(52) U.S. Cl.
CPC ..... *A61H 3/008* (2013.01); *A63B 21/00181* (2013.01); *A63B 23/04* (2013.01)

(58) Field of Classification Search
CPC ..... A61H 3/008; A63B 7/00; A63B 21/00181
USPC ..... 482/43, 69
See application file for complete search history.

(56) References Cited

U.S. PATENT DOCUMENTS

| | | | | |
|---|---|---|---|---|
| 1,611,807 | A | 12/1926 | Bergh | |
| 2,625,202 | A | 1/1953 | Richardson | |
| 2,812,010 | A | 11/1957 | Abdallah | |
| 2,819,755 | A | 1/1958 | Berger | |
| 3,252,704 | A | 5/1966 | Wilson | |
| 3,761,082 | A | 9/1973 | Barthel | |
| 4,903,355 | A | 2/1990 | Hickerson | |
| 4,911,426 | A * | 3/1990 | Scales | A61H 3/008 128/845 |
| 4,948,156 | A | 8/1990 | Fortner | |
| 5,273,502 | A | 12/1993 | Kelsey | |
| 5,458,550 | A * | 10/1995 | Braim | A47D 13/04 297/274 |
| 5,526,893 | A | 6/1996 | Higer | |
| 5,530,976 | A | 7/1996 | Horcher | |
| 5,601,527 | A * | 2/1997 | Selkowitz | A61H 3/008 254/413 |
| 5,695,432 | A | 12/1997 | Soderlund | |
| 5,704,881 | A | 1/1998 | Dudley | |
| 6,890,288 | B2 | 5/2005 | Bingham | |
| 7,255,666 | B2 * | 8/2007 | Cardenas | A61H 1/0229 482/143 |
| 7,381,163 | B2 | 6/2008 | Gordon | |
| 7,462,138 | B2 | 12/2008 | Shetty | |
| 7,468,023 | B2 | 12/2008 | Wu | |
| 7,540,045 | B2 | 6/2009 | Nativ | |
| 2004/0074414 | A1 | 4/2004 | Phillips | |

OTHER PUBLICATIONS

Guldmann Inc., screenshot of website, www.guldmann.net; Feb. 23, 2010.
BIA USA, Rehabilitation Services for People of All Ages, The Challenge!; Spring 2013.

* cited by examiner

*Primary Examiner* — Oren Ginsberg
(74) *Attorney, Agent, or Firm* — Standley Law Group LLP

(57) ABSTRACT

An exercise apparatus adapted to hang from an overhead structure used for providing walking and ambulation assistance to users in aid of exercise and physical rehabilitation. The device has a pulley assembly adapted for anchoring directly to an overhead structure or indirectly by a track secured thereto, and includes a hoist line permitting manual force to be used to raise and lower a sling assembly that is secured in the underarms of the user for lifting.

22 Claims, 5 Drawing Sheets

OVERHEAD STANDING AND AMBULATION ASSISTIVE EXERCISE DEVICE

CROSS-REFERENCE TO RELATED APPLICATIONS

This application claims priority to U.S. Application No. 62/007,999 filed on Jun. 5, 2014, which is herein incorporated by reference in its entirety.

TECHNICAL FIELD

Exemplary embodiments of the present invention relate generally to mechanical devices, and more specifically to exercise devices for use in providing standing or ambulation assistance to users.

BACKGROUND OF THE INVENTION

There is a continuing need for improved devices and methods for supporting users in upright positions and postures to provide assistance with standing, ambulation and strengthening exercises related thereto. Some traumatic injuries or illnesses, for instance, can cause a person to become disabled with little to no use of one or more legs, feet, hips, spine or other such parts used in standing and walking. In those cases, ambulation or even the act of standing may not be achievable without assistance being provided to the user. Oftentimes, after extensive recovery periods, physical rehabilitation, strengthening and other such exercise is needed to improve or return standing or walking abilities to the injured person. The need to provide lift to those persons is greatest in cases where they cannot stand under their own power.

In the rehabilitation or strengthening process for disabled persons, it is also desirous to provide lifting assistance during exercise while at the same time permitting free use of other limbs for grasping objects, supports, weights, or generally so that the user can experience the most natural standing posture and freedom of movement possible. It is also desirous for the lifting support to be applied to the user in such a manner so as not to cause discomfort, as well as to further the goal of allowing free and natural movement when engaged with the device.

Some known devices incorporate a frame, or base structure, from which various support components depend to engagingly provide support to a user. Some frames are wheeled or otherwise provide a means for moving the device, thereby allowing the user to move about on a surface while being supported by the device. While such devices are useful in providing mobile standing and walking assistance and are free standing, such devices are disadvantageous in that they require large open spaces and smooth, even surfaces on which to rest. For users wishing to rehabilitate at home, many of the prior art framed, mobile and floor-supported devices require excessive room for home use, or use in any other situations in which space is limited. Furthermore, even where space is not so limited, bulky frames and structural components have the disadvantage of impeding free movement of the user's limbs, can make it difficult for others to move close to the body of the user when providing exercise assistance, and generally can reduce the user's experience by impeding vision, mobility and feelings of openness.

Other known configurations utilize harnesses and other multi-point support systems when engaging with a user in order to provide lifting assistance. Many of those devices combine a variety of engagement points with the user's body with the goal of increasing the comfort to the user resulting from the applied forces. For example, torso, legs, pelvic girdle and underarm supports have been used to distribute the lifting forces. However, while these known devices may advantageously increase user comfort, they tend to also exhibit the disadvantage of impeding free movement of a user's limbs, and may be cumbersome to some to wear in practice.

Furthermore, some of the known devices incorporate a seat portion that is detachable from a specialty wheeled chair that is compatible with the seat, for instance. While those types of devices benefit the user by incorporating the lifting forces into the chair being used by the user, it also has the disadvantage of limiting the seating devices available for use in that they must be compatible with the support system.

Other known devices have utilized only an underarm sling in engagement with the user to transmit lifting forces thereto. The use of an underarm sling is advantageous in that the user is provided with increased freedom of movement during exercise and because it is compatible with any chair or sitting device. Current known underarm sling configurations, however, present further obstacles and disadvantages. For example, some slings are constructed of hollow materials and filled with a gas or fluid in order to increase comfort to the user. This advantage creates the need for refilling and sealing means in the sling, make it more difficult to clean between uses and further introduces the potential for puncture, rupture and spills.

Many slings are also constructed at least in part of elastic material that allows the sling to stretch when placed through the underarms of a user and the user's weight applied. While this has been believed to increase comfort, there remains potential for chafing and irritation of the user's skin due to expansion and contraction of elastic slings during use, and do not provide adequate haptic feedback during exercise and rehabilitation exercises due to the elasticity of the sling.

Furthermore, there exists a need in the art for an exercise and support device that provides standing and ambulation assistance to a user that is easy to assemble and operate at low cost. Many devices in the prior art currently are bulky, cumbersome and expensive, thereby presenting a barrier to use for many persons in need of an assistive exercise device.

It is therefore an unmet need in the prior art for a device that supports a user, thereby providing standing and walking assistance, that is compatible with any chair or sitting surface from which the user may wish to stand, that does not require any ground-based structures, installations or other such obstacles, that permits maximum and natural freedom of movement to the user, that does not require a motor, winch, etc., that provides increased haptic feedback to the user, and is inexpensive and easy to use.

BRIEF SUMMARY OF THE INVENTION

Exemplary embodiments of the present disclosure pertain to exercise apparatuses for hanging from an overhead structure to provide standing assistance to a user with arms and a leg. These embodiments include a stabilizer member having an elongate shape forming a longitudinal length between two opposing ends, a lift sling depending from the two opposing ends adapted for being placed under the arms of the user, at least one suspension member having first and second ends wherein the first and second ends are each attached to the stabilizer member at a connection point, each connection point being equally spaced apart along the longitudinal length of the stabilizer member, and a hoist assembly connected to the at least one suspension member. The hoist assembly has a pulley assembly being adapted for anchoring the hoist assembly to the overhead structure, and a hoist line engaged to the pulley assembly whereby the lift sling is vertically moveable relative to the overhead structure.

In some exemplary embodiments, the hoist assembly is provided with a fixed pulley assembly, a hoist line and a coupling member. The fixed pulley assembly has a fixed block having bearings and adapted for being anchored to the overhead structure, and a fixed pulley on a fixed pulley axle mounted within the bearings. The hoist line is engaged with the fixed pulley assembly and has a proximal end and a distal end. The coupling member joins the at least one suspension member with the proximal end of the hoist line, whereby the lift sling is vertically moveable relative to the overhead structure.

Further exemplary embodiments are disclosed wherein the hoist assembly is provided with a fixed pulley assembly, a free pulley assembly and a hoist line. The fixed pulley assembly has a fixed block having fixed pulley bearings and being adapted for being anchored to the overhead structure, and a fixed pulley on a fixed pulley axle mounted within the fixed pulley bearings. The free pulley assembly has a free block having free pulley bearings and being connected to the at least one suspension member between the first and second ends, and a free pulley on a free axle mounted within the free pulley bearings. The hoist line is engaged to the fixed and free pulley assemblies in a gun tackle configuration and has a proximal end and a distal end, wherein the proximal end of the hoist line is attached to the fixed pulley assembly whereby the lift sling is vertically moveable relative to the overhead structure.

An objective of the present invention is to improve haptic feedback to a user with increased comfort, and further to provide a cleanable sling. In some embodiments, the lift sling is provided with a core and a padded shell. The core has a first end and a second end, each adapted for connection to an end of the two opposing ends of the stabilizer member, and a middle portion extending between the first and second ends. The padded shell encases the middle portion of the core. Haptic feedback is improved in embodiments wherein the core is made of an inelastic material, and others wherein the core is made of a woven polyamide material. Increased comfort is provided in embodiments wherein the padded shell is made of polyethylene foam formed in a hollow cylindrical shape. Sanitation is improved in embodiments wherein the padded shell is further provided with a longitudinally extending opening such that the padded shell is removable from the exercise apparatus.

A further objective of the present invention is to allow users receiving standing assistance from the exercise apparatus to walk a distance without ground-based interfering components. Exemplary embodiments are disclosed wherein the fixed block comprises bearings and a wheel adapted for installation on a track affixed to the overhead structure whereby the fixed block is moveable linearly along the track and fixed with respect to vertical movement.

Yet another objective is to provide the exercise apparatus with a belt adapted to be worn by the user and having a pair of hand grips adapted to be gripped by the user to secure the lift sling in the underarms of the user and prevent slippage.

An additional objective of the disclosure is to promote rehabilitation or weight training to improve motor skills, strength or ambulation. Exemplary embodiments are provided with a leg weight adapted to be secured to the leg of the user for use in resistance weight training.

Another objective of the disclosure is to provide a low cost kit that may be purchased and assembled at home or elsewhere. Exemplary embodiments of the kit include a lift sling assembly, a padded shell, a pulley assembly being adapted for anchoring to the overhead structure, and a hoist line. The lift sling has a stabilizer member having an elongate shape forming a longitudinal length between two opposing ends, a lift sling affixed to the stabilizer member at the two opposing ends, at least one suspension member having a first end and a second end, and a coupling member. The first and second ends of the suspension member are each attached to the stabilizer member at a connection point, each connection point being equally spaced apart along the longitudinal length of the stabilizer member. The at least one suspension member extends through the coupling member between the first and second ends. Other embodiments of the kit include a belt adapted to be worn by the user and having a pair of hand grips. Additional embodiments of the kit include a leg weight adapted to be secured to the leg of a user.

It is an object of this invention to provide an exercise apparatus of the type generally described herein and being adapted for the purposes set forth herein, and overcoming disadvantages found in the prior art. These and other advantages are provided by the invention described and shown in more detail below.

BRIEF DESCRIPTION OF THE SEVERAL VIEWS OF THE DRAWINGS

Novel features and advantages of the present invention, in addition to those mentioned above, will become apparent to those skilled in the art from a reading of the following detailed description in conjunction with the accompanying drawings wherein identical reference characters refer to identical parts and in which.

DETAILED DESCRIPTION OF THE INVENTION

Figure 1:
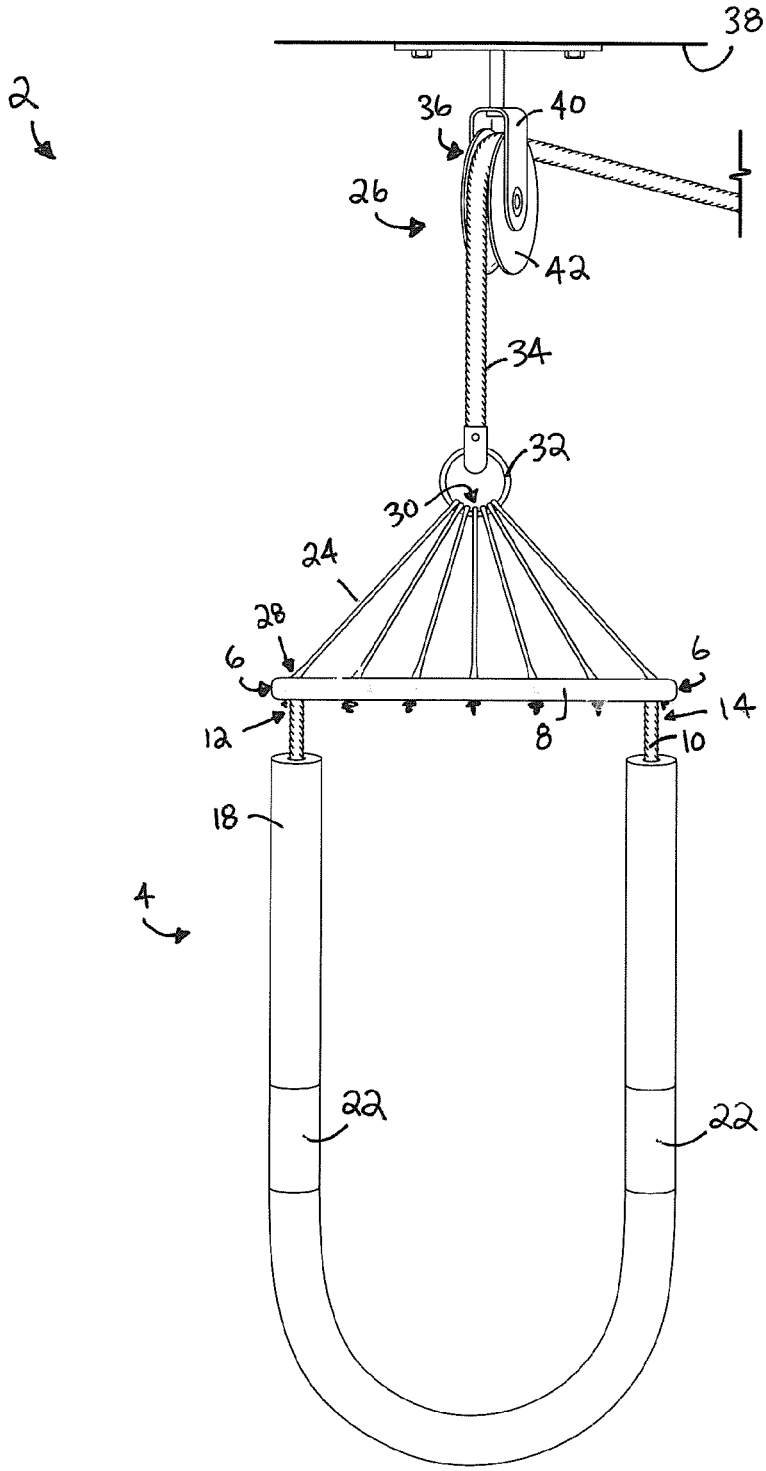
FIG. 1 is a perspective view of a first embodiment of the invention.

FIG. 1 is a perspective view of a first embodiment of the invention. In this embodiment the exercise apparatus 2 is provided with a lift sling 4 depending from two opposing ends 6 of a stabilizer member 8. The lift sling 4 is adapted for placement in the underarms of a user (see FIGS. 2 and 3 for further detail) whereat a lifting force is applied to transfer a lifting force to the user, thereby providing support and assistance in standing, ambulation or generally during strengthening or rehabilitation exercises. The remainder of this disclosure will use the term "standing" to generally refer to any and all activities that may be aided with a lifting force applied to a user to assist in maintaining a generally upright posture and to avoid falls during such activity, and as such should be understood to encompass those activities and uses generally without limitation to the scope of the invention.

The lift sling 4 is made of any material that is suitable for safely supporting all of the body weight of a user, such material being generally chosen to meet those tensile strength requirements while being comfortable when transferring the lifting force to the user wearing the lift sling 4. Preferably, the lift sling 4 is provided with a core element 10 that supports the user by transferring body weight via tensile stress to the stabilizer member 8, and optionally may be made of a relatively inelastic material so that a user may experience direct tactile feedback when their body weight is unevenly distributed thereon. For example, a core 10 made of a woven polyamide material such as nylon may be used to help a user to more ably feel when they are off balance, while also having sufficient strength to lift the portion of the user's body weight not being supported by the user. The core 10 may alternatively be constructed of a thin metal, alloy, or any other material having sufficient strength and characteristics in accordance with the present disclosure. The core 10 is the load bearing element of the lift sling 4, and has a first end 12, a second end 14 and a middle portion 16 extending there between (visible in FIG. 4A), each end 12 and 14 being adapted for connection to one of the two opposing ends 6 of the stabilizer member 8.

To further increase the comfort of the lift sling 4 to the user, it may optionally be provided with a padded shell 18 encasing the middle portion 16 of the core 10. The padded shell 18 is preferably provided in a hollow cylindrical shape with a longitudinally extending opening 20 (visible in FIG. 4B) such that the padded shell 18 is removable from the exercise apparatus for cleaning, or in order to replace an existing shell with a new shell. It is preferred that the padded shell 18 be made of a lightweight, deformable material for increased user comfort, such as a polyethylene foam material, but any material or blend may be used to suit the needs of a particular application. The padded shell 18 disclosed herein is preferred over prior art devices utilizing slings having gas, liquid or solutions encased therein, it has been observed that a homogeneous, lightweight material is preferred in the avoidance of spills due to rupture or puncture, in the avoidance of maintenance (e.g., filling or emptying) needed on such devices, and further because the reduced weight of the embodiments of the padded shell reduces the input forces required to lift the user.

The padded shell 18 may optionally be provided with one or more removable protective coverings 22 that are slidable for positioning around the longitudinal sections of the padded shell that will contact the underarms of the user being lifted. The use of such protective coverings 22 is desirable in that the usable life of the padded shell 18 is extended because it is protected from soiling due to use.

The stabilizer member 8 is a rigid body, preferably constructed of aluminum, an aluminum alloy, wood or combination of materials (although any material having suitable strength characteristics may be used) of a length wherein the attachment of the lift sling 4 to the two opposing ends 6 of the stabilizer member 8 provides sufficient space for the lift sling 4 to fit comfortably around the torso of the user. If desired, optional width adjustments (not shown) may be provided wherein the distance between the connection points between the first 12 and second 14 ends of the core 10 and the two opposing ends 6 of the stabilizer member 8 is adjustable. When unloaded and the device 2 depends from overhead, or when a portion of the body weight of a user is distributed evenly on the lift sling 4, the stabilizer member 8 is in a generally horizontal position, and swivels from the horizontal position when an uneven load is applied, such as when a user stumbles or is unsteady in the upright position. It is considered advantageous that the disclosed stabilizer member 8 is provided with no protrusions therefrom for attaching the lift sling 4, suspension members 24 or other elements, as is provided in the prior art. The avoidance of protruding connections is considered an improvement over the prior art in that the safety to the user of the device is increased by eliminating elements of the device that could be harmful if there were to forcefully contact the head or other body parts of a user.

The stabilizer member 8 is supported by at least one but preferably at least three suspension members 24 that connect the stabilizer member 8 to a hoist assembly 26 through which a lifting force is applied. The first and second ends 28 of each suspension member 24 are coupled to the stabilizer member 8 at a connection point 30, said connection points 30 being spaced apart equally, and preferably symmetrically with respect to each suspension member used, along the longitudinal length of the stabilizer member 8 to provide stabilizing action to counteract unbalanced forces that may be applied through the lift sling 4 during use. The suspension members 24 may be coupled to the stabilizer member 8 using any known techniques, and may be configured with or without replacement capabilities. It is preferred that the suspension members are attached to the stabilizer member at a first end, extend through a coupling member, and back to attach to the stabilizer member at a second end—effectively looping through the coupling member. Where a wooden stabilizer member is employed, the first and second ends of the suspension members may be knotted and retained within vertical channels in the stabilizer member. Alternatively, the suspension members may attach to the stabilizer bar at a first end, and to a coupling member at a second end.

In this embodiment, each suspension member 24 is coupled to the hoist assembly 26 at a coupling member 32 that is in turn coupled to a hoist line 34. Each suspension member 24 is looped through the coupling member at a midpoint 30. The linear lifting force is translated through the hoist line 34 to the coupling member 32, which permits a generally single gathering point for suspension member attachment. From the coupling member 32, the suspension members 24 and stabilizing member 8 translate the lifting force and distribute it to the ends 12 and 14 of the lift sling 4. The embodiment shown in FIG. 1 depicts the coupling member 32 as a ring of preferably metal or alloy material, but any comparable structure that serves to connect the hoist line 34 to the suspension members 24 is considered usable and disclosed herein.

The hoist assembly 26 is further provided with a pulley assembly 36 that is adapted for anchoring to an overhead structure 38, such as a ceiling, cantilever support, or the like. The hoist line 34 may be any desired length (as represented by the broken line in FIG. 1) and is engaged with the pulley assembly 26 such that a lifting force applied to one end is directed downwardly by the hoist assembly 26 and ultimately to the lift sling 4, thereby providing standing assistance to a user. In this embodiment, the pulley assembly 36 is provided with a fixed block 40 having bearings and a fixed pulley 42 on a fixed pulley axle (not indicated for purposes of clarity) mounted within the bearings. Note that the fixed block 40 is the element of the hoist assembly 26 that is adapted for anchoring to the overhead structure 38 in this embodiment.

As will be appreciated in view of this embodiment, the invention 2 may quickly and easily be anchored to an overhead structure 38 to hang therefrom, and another person assisting the user can simply provide standing assistance to the user by manually applying a lifting force to the hoist line 26. In this manner, an inexpensive means is provided for a user to receive assistance in standing, and advantageously may be installed in the user's home, wherein a friend or family member may readily provide assistance or the assistance of a healthcare professional may be received.

Figure 2:
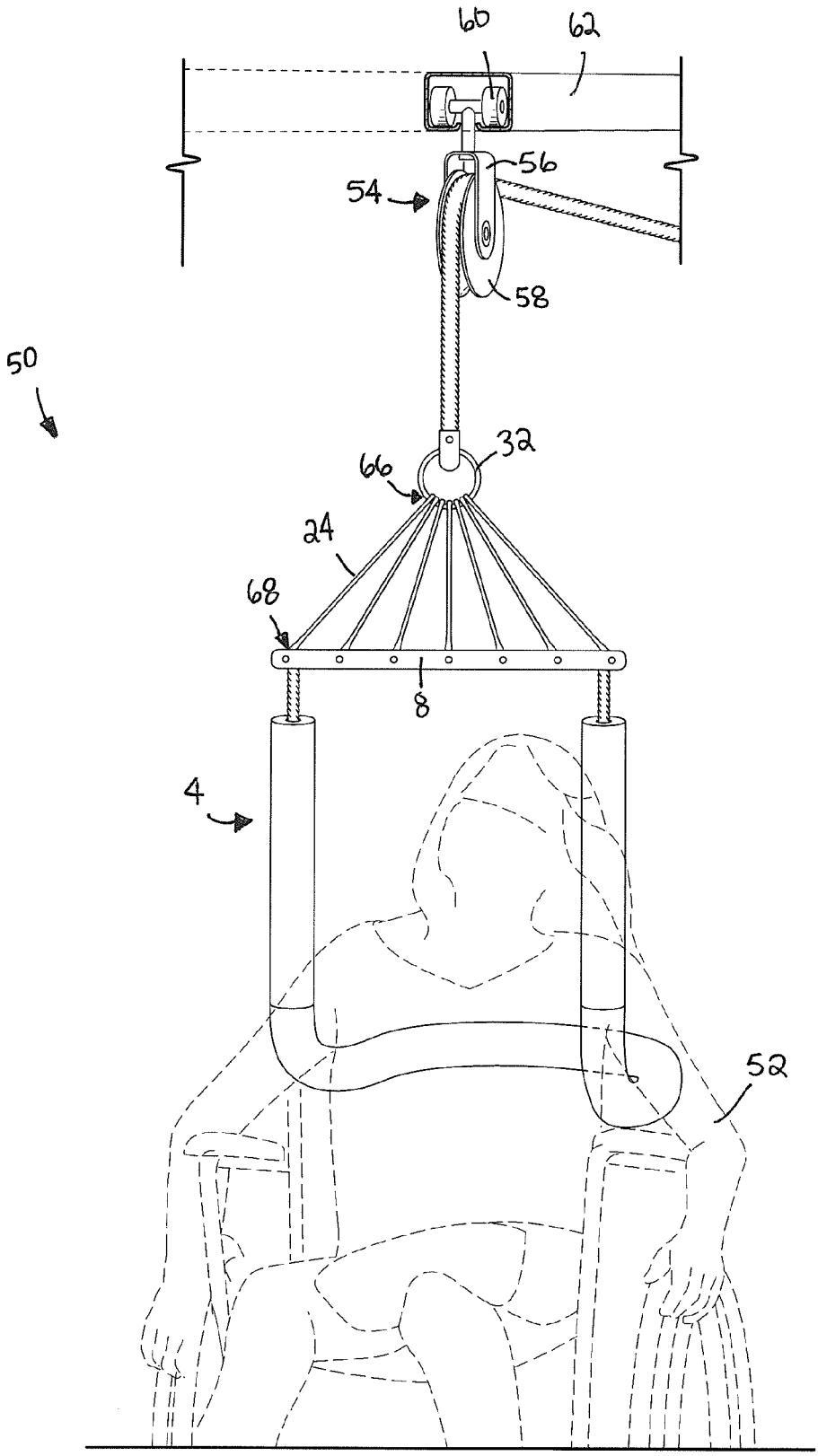
FIG. 2 is a perspective view of a second embodiment of the invention engaged with a seated user.

Turning now to FIG. 2, a second embodiment of the invention 50 is shown in perspective view and engaged with a seated user 52. From a seated position, if desired, a user 52 engages with the device 50 by wrapping the lift sling 4 around the torso to engage with their underarms. Preferably, the lift sling 4 is wrapped around the torso of the user so that it rests on the user's back, as opposed to the front. This embodiment is further provided with a fixed pulley assembly 54 also having a fixed block 56 and a fixed pulley 58 as described above in connection with FIG. 1, but with the difference being that the fixed block 56 is configured with bearings and a wheel 60 adapted for installation on a track 62 affixed to the overhead structure. This configuration permits the fixed block 56 to be moveable linearly along the track 62 while remaining fixed with respect to vertical movement. This embodiment is advantageous for use in situations in which the user wishes to include lateral motion, such as walking, in exercise activities while engaged with the device 50. Note also that the embodiment shown in FIG. 2 employs a coupling member 32 connected to the upper ends 66 of the suspension members 24, and also employs a rivet type connection between the stabilizer member 8 and the lower ends 68 of the suspension members.

Figure 3:
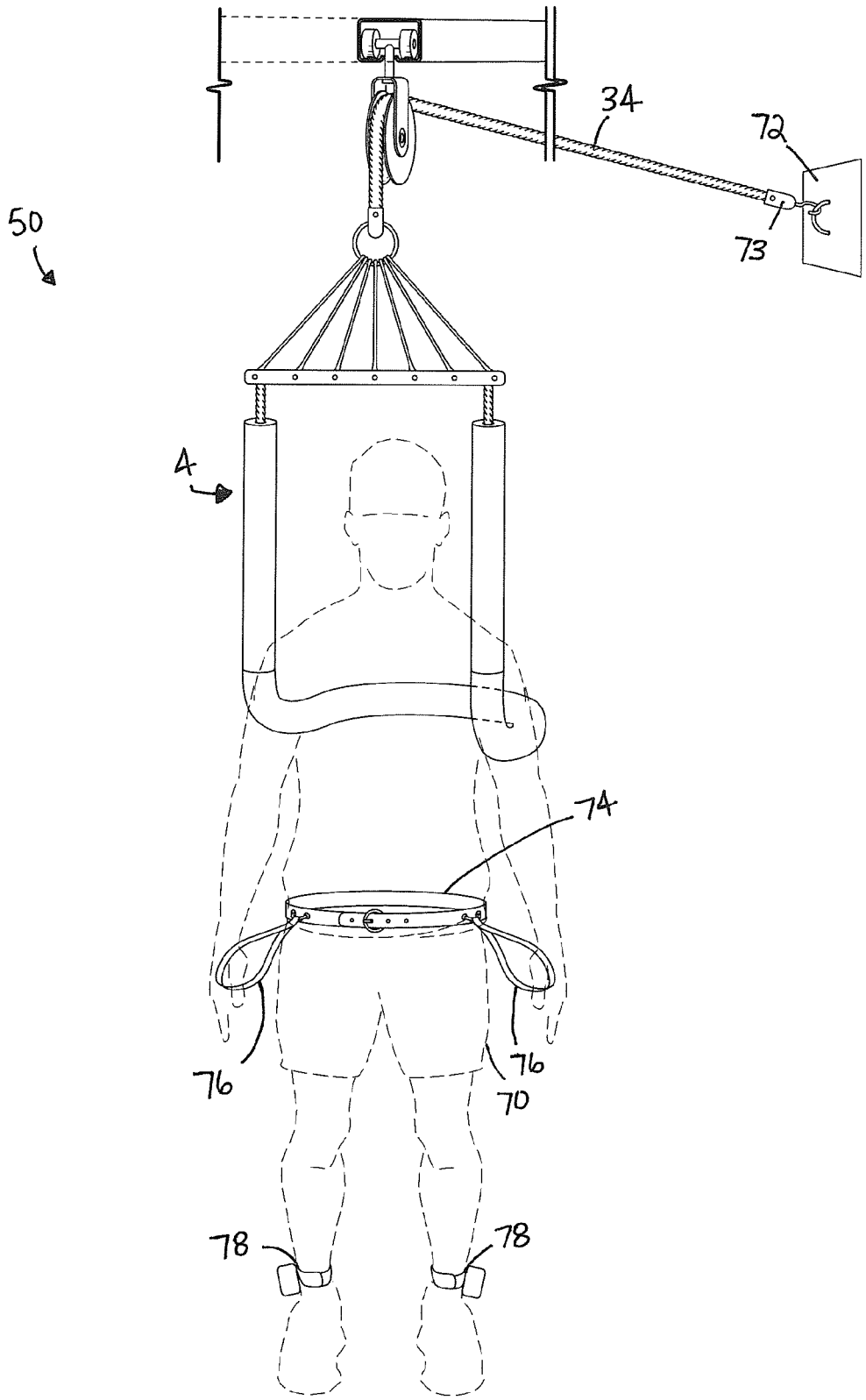
FIG. 3 is a perspective view of the second embodiment of the invention engaged with a standing user and additional features.

In FIG. 3 a perspective view of the second embodiment of the invention 50 is shown wherein it is engaged with a user 70 standing in an upright position. FIG. 3 also illustrates the use of several preferable but optional features that may be included in the invention 50. For example, a hoist line tie-off 72 may be provided for mounting to a surface, such a wall in a room or any other fixed surface or object of sufficient strength. The use of a tie-off 72 and a corresponding attachment end 73 on the hoist line 34 is considered advantageous because it permits a person (not shown) providing assistance to the user 70 to tie-off the hoist line 34 so that the lift sling 4 is immobilized at a particular height in order to approach the user 70 to provide further assistance or training instruction without being encumbered by the weight of the hoist line 34. This obviates the need for multiple persons to properly instruct, train or otherwise assist the user 70 safely, and in some cases for which healthcare professionals are needed significantly reducing the cost of such services to the user 70.

Also shown in FIG. 3 is a belt 74 having one or more hand grips 76. While it is preferred that the hand grips 76 be configured as loops of material anchored to the belt 74, the hand grips may be solid, and may attach to or form part of the belt 74 if so desired, and the depiction of the embodiment shown in FIG. 3 should not be understood to limit the scope of the claimed invention. The belt 74 is adapted to be worn by the user 70, preferably about the waist. The belt 74 and hand grips 76 allow the user 70 to grip and hold to keep their arms oriented downward at their sides to resist the tendency of the lift sling 4 to raise the arms upward, thereby keeping the lift sling 4 from slipping off of the torso of the user 70.

Additional training elements may be incorporated into and used in conjunction with the invention 50 to improve strength training and rehabilitation of the muscle systems needed for standing. For example, one or more leg weights 78 may be used and strapped to the legs, ankles, feet, etc. of the user 70 to provide resistance to movement.

Figure 4A:
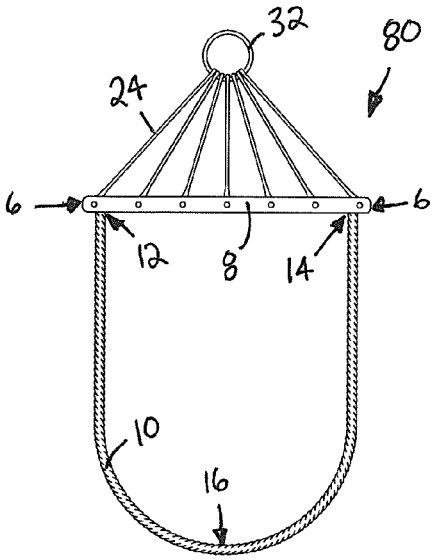
FIGS. 4A-4F are perspective views of several elements of a kit embodiment of the invention.

FIGS. 4A-4F each include a perspective view of one of several elements of a kit embodiment of the invention. FIG. 4A is a lift sling assembly 80 that may optionally come preassembled in the kit. The kit assembly 80 includes a stabilizer member 8, the lift sling core 10 coupled to the two opposing ends 6 of the stabilizer member 8, a plurality of suspension members 24 coupled to the stabilizer member 8 at each end and looped through the coupling member 32 therebetween. The preassembly of the lift sling assembly 80 is preferred because more permanent and durable connections may be employed at the coupling member 32 and suspension member 24 coupling, and the stabilizer member 8 coupling with the suspension members 24 and the lift sling core 10.

Figure 4D:
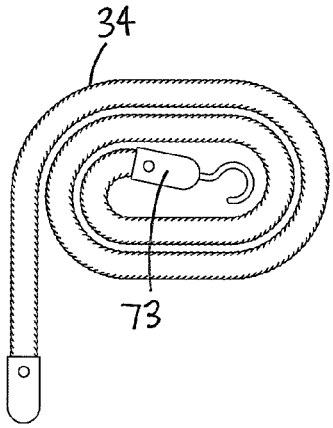
Figure 4B:
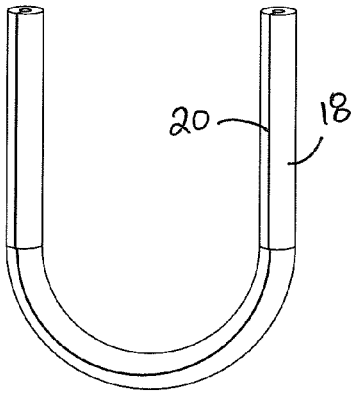
Figure 4E:
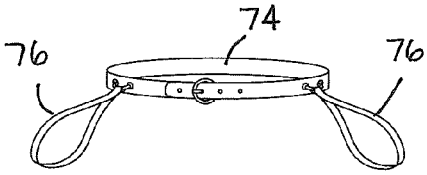
Figure 4C:
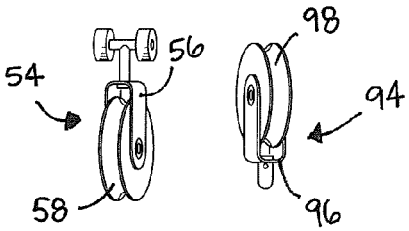
Figure 4F:
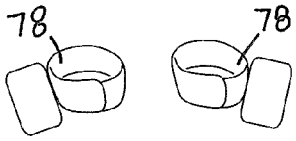

The kit may include one or more padded shells 18 as shown in FIG. 4B, which can be sold separately for easy replacement during the product lifetime if needed. FIG. 4C illustrates an exemplary pulley assembly that may be included in the kit for installation by the purchaser. A tracked fixed block 56 is shown along with a free pulley assembly (see FIG. 5), but any of the pulley assembly embodiments and equivalents thereto may be included in the kit, together or separately. Likewise, FIG. 4D depicts a hoist line 34 having an optional attachment end 73 for a tie-off (not shown), although a hoist line without an optional attachment end may be included in addition to, or instead of, the line shown in this figure. Finally, FIGS. 4E and 4F illustrate, respectively a belt 74 with hand grips 76 and leg weights 78 that may be optionally included in a kit embodiment of the invention.

Figure 5:
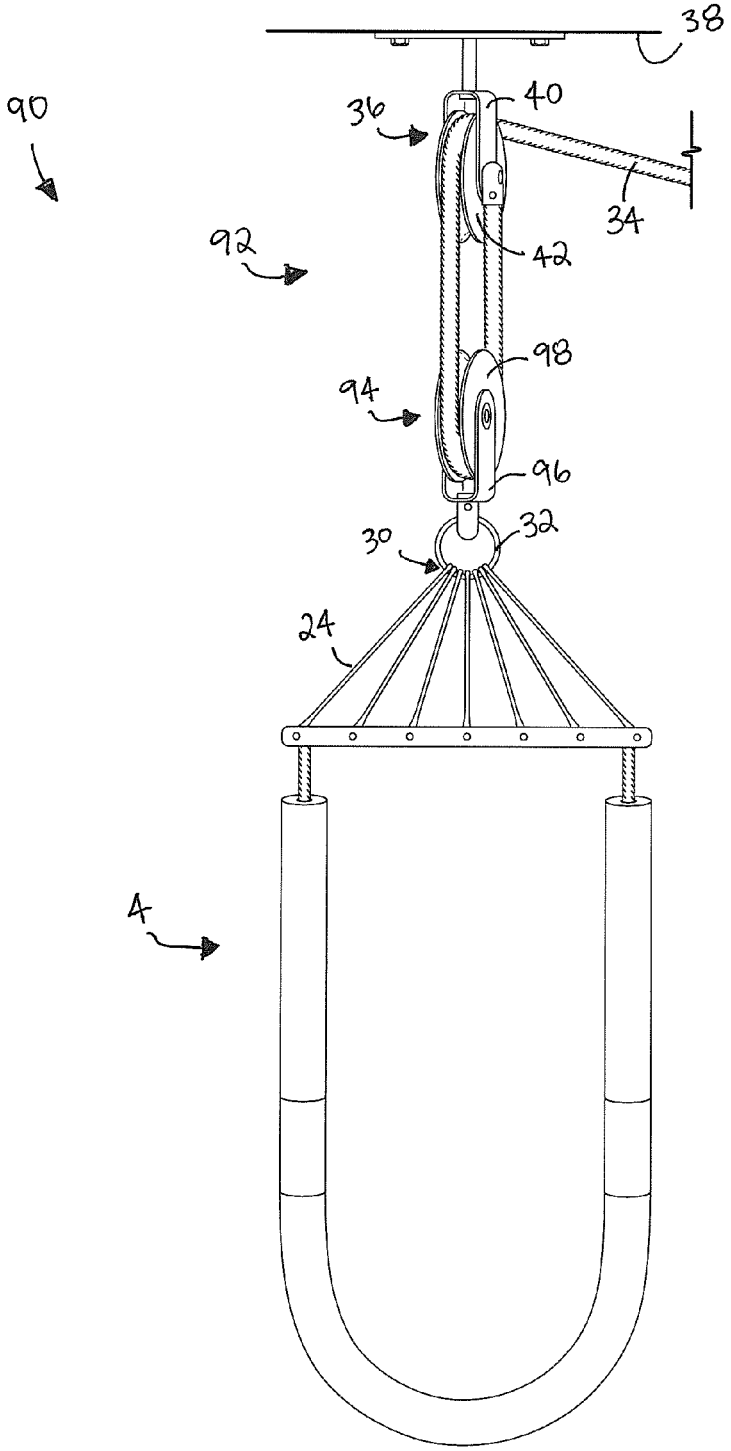
FIG. 5 is a perspective view of a third embodiment of the invention.

A third embodiment of the invention 90 is illustrated in perspective view in FIG. 5. The pulley assembly 92 employed by this embodiment includes a fixed pulley assembly 36 as shown in connection with FIG. 1, and further a free pulley assembly 94. The fixed pulley assembly 36 includes the fixed block 40 having fixed pulley bearings and being adapted for anchoring to an overhead structure 38, and further a fixed pulley 42 on a fixed pulley axle mounted within the fixed pulley bearings of the fixed block 40. The free pulley assembly 94 includes a free block 96 having free pulley bearings and is connected generally to the suspension members 24. The connection may be by direct coupling of an upper end 30 of the suspension members 24, or indirectly, for example through the use of a coupling member 32 as described above, wherein the suspension members are looped through the coupling member. The free pulley assembly 94 further includes a free pulley 98 on a free pulley axle mounting with the free pulley bearings of the free block 96. The hoist line 34 is engaged with the pulley assembly 92 in a gun tackle configuration, thereby yielding a mechanical advantage of two from the perspective of the input force needed to lift a user engaged to the lift sling 4. Other pulley configurations are of course possible without limiting the claim invention and are not shown for the purposes of brevity.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain some of the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

What is claimed is:

1. An exercise apparatus for hanging from an overhead structure to provide standing assistance to a user with arms and a leg comprising:

a stabilizer member having an elongate shape forming a longitudinal length between two opposing ends;

a lift sling depending from the two opposing ends adapted for being placed under the arms of the user;

at least one suspension member having a first end and a second end, and wherein the first and second ends are each attached to the stabilizer member at a connection point, each connection point being equally spaced apart along the longitudinal length of the stabilizer member; and a hoist assembly connected to the at least one suspension member and comprising:

a pulley assembly being adapted for anchoring the hoist assembly to the overhead structure; and a hoist line engaged to the pulley assembly whereby the lift sling is vertically moveable relative to the overhead structure.

2. The exercise apparatus of claim 1, wherein the hoist assembly comprises:

a fixed pulley assembly comprising:

a fixed block comprising bearings and adapted for being anchored to the overhead structure; and a fixed pulley on a fixed pulley axle mounted within the bearings;

the hoist line engaged with the fixed pulley assembly and having a proximal end and a distal end; and a coupling member joining the at least one suspension member with the proximal end of the hoist line, whereby the lift sling is vertically moveable relative to the overhead structure.

3. The exercise apparatus of claim 2, wherein the lift sling further comprises:

a core comprising:

a first end and a second end, each adapted for connection to an end of the two opposing ends of the stabilizer member; and a middle portion extending between the first and second ends of the core; and a padded shell encasing the middle portion of the core.

4. The exercise apparatus of claim 3, wherein the core is comprised of an inelastic material.

5. The exercise apparatus of claim 3, wherein the core is comprised of a woven polyamide material.

6. The exercise apparatus of claim 4, wherein the padded shell is comprised of polyethylene foam formed in a hollow cylindrical shape.

7. The exercise apparatus of claim 6, wherein the padded shell further comprises a longitudinally extending opening such that the padded shell is removable from the exercise apparatus.

8. The exercise apparatus of claim 2, wherein the fixed block comprises bearings and a wheel adapted for installation on a track affixed to the overhead structure whereby the fixed block is moveable linearly along the track and fixed with respect to vertical movement.

9. The exercise apparatus of claim 2, further comprising a belt adapted to be worn by the user comprising a pair of hand grips.

10. The exercise apparatus of claim 2, further comprising a leg weight adapted to be secured to the leg of the user.

11. The exercise apparatus of claim 1, wherein the hoist assembly comprises:

a fixed pulley assembly comprising:

a fixed block comprising fixed pulley bearings and adapted for being anchored to the overhead structure; and a fixed pulley on a fixed pulley axle mounted within the fixed pulley bearings;

a free pulley assembly comprising:

a free block comprising free pulley bearings and being connected to the at least one suspension member between the first and second ends; and a free pulley on a free axle mounted within the free pulley bearings; and the hoist line engaged to the fixed and free pulley assemblies in a gun tackle configuration and having a proximal end and a distal end, wherein the proximal end of the hoist line is attached to the fixed pulley assembly whereby the lift sling is vertically moveable relative to the overhead structure.

12. The exercise apparatus of claim 11, wherein the lift sling further comprises:

a core comprising:

a first end and a second end, each adapted for connection to an end of the two opposing ends of the stabilizer member; and a middle portion extending between the first and second ends of the core; and a padded shell encasing the middle portion of the core.

13. The exercise apparatus of claim 12, wherein the core is comprised of an inelastic material.

14. The exercise apparatus of claim 13, wherein the padded shell is comprised of polyethylene foam formed in a hollow cylindrical shape.

15. The exercise apparatus of claim 14, wherein the padded shell further comprises a longitudinally extending opening such that the padded shell is removable from the exercise apparatus.

16. The exercise apparatus of claim 12, wherein the core is comprised of a woven polyamide material.

17. The exercise apparatus of claim 11, wherein the fixed block comprises bearings and a wheel adapted for installation on a track affixed to the overhead structure whereby the fixed block is moveable linearly along the track and fixed with respect to vertical movement.

18. The exercise apparatus of claim 11, further comprising a belt adapted to be worn by the user comprising a pair of hand grips.

19. The exercise apparatus of claim 11, further comprising a leg weight adapted to be secured to the leg of the user.

20. A kit comprising:

a pulley assembly being adapted for anchoring to an overhead structure;

a lift sling assembly comprising:

a stabilizer member having an elongate shape forming a longitudinal length between two opposing ends;

a lift sling affixed to the stabilizer member at the two opposing ends;

at least one suspension member having a first end and a second end, and wherein the first and second ends are each attached to the stabilizer member at a connection point, each connection point being equally spaced apart along the longitudinal length of the stabilizer member; and a coupling member through which the at least one suspension member extends;

a padded shell for removably encasing the lift sling; and a hoist line.

21. The kit of claim 20, further comprising a belt adapted to be worn by a user comprising a pair of hand grips.

22. The kit of claim 21, further comprising a leg weight adapted to be secured to the leg of the user.

* * * * *